US009035718B2

(12) United States Patent
Tamaru

(10) Patent No.: US 9,035,718 B2
(45) Date of Patent: May 19, 2015

(54) DIRECTIONAL COUPLER

(71) Applicant: Murata Manufacturing Co., Ltd., Nagaokakyo-shi, Kyoto-fu (JP)

(72) Inventor: Ikuo Tamaru, Nagaokakyo (JP)

(73) Assignee: Murata Manufacturing Co. Ltd., Kyoto (JP)

( * ) Notice: Subject to any disclaimer, the term of this patent is extended or adjusted under 35 U.S.C. 154(b) by 145 days.

(21) Appl. No.: 13/890,429

(22) Filed: May 9, 2013

(65) Prior Publication Data

US 2013/0241667 A1 Sep. 19, 2013

Related U.S. Application Data

(63) Continuation of application No. PCT/JP2011/075191, filed on Nov. 1, 2011.

(30) Foreign Application Priority Data

Jan. 12, 2011 (JP) ..... 2011-003921

(51) Int. Cl.
*H01P 5/18* (2006.01)
*H01P 3/08* (2006.01)

(52) U.S. Cl.
CPC . *H01P 5/18* (2013.01); *H01P 5/187* (2013.01)

(58) Field of Classification Search
CPC ..... H01P 5/18; H01P 5/183
USPC ..... 333/109, 112, 115, 117, 118
See application file for complete search history.

(56) References Cited

U.S. PATENT DOCUMENTS

| | | | | |
|---|---|---|---|---|
| 6,208,220 | B1 * | 3/2001 | Logothetis | 333/116 |
| 6,411,181 | B1 | 6/2002 | Ishikawa et al. | |
| 6,515,556 | B1 | 2/2003 | Kato et al. | |
| 8,314,663 | B2 * | 11/2012 | Tamaru et al. | 333/109 |
| 8,629,736 | B2 * | 1/2014 | Tamaru | 333/109 |
| 2008/0062723 | A1 | 3/2008 | Fujiki et al. | |
| 2008/0258838 | A1 | 10/2008 | Oshima | |
| 2013/0241667 | A1 * | 9/2013 | Tamaru | 333/109 |

FOREIGN PATENT DOCUMENTS

| | | | |
|---|---|---|---|
| JP | 08-237012 | A | 9/1996 |
| JP | 11-219824 | A | 8/1999 |
| JP | 2001-077609 | A | 3/2001 |
| JP | 2001-144513 | A | 5/2001 |
| JP | 2003-069317 | A | 3/2003 |
| WO | 2006/123482 | A1 | 11/2006 |

OTHER PUBLICATIONS

Official Communication issued in corresponding Chinese Patent Application No. 201180062865.5, mailed on Apr. 25, 2014.
Official Communication issued in International Patent Application No. PCT/JP2011/075191, mailed on Feb. 7, 2012.

* cited by examiner

*Primary Examiner* — Dean Takaoka
(74) *Attorney, Agent, or Firm* — Keating & Bennett, LLP

(57) ABSTRACT

A directional coupler includes in a laminate block, a first main line, a first sub-line, a second sub-line, and a second main line sequentially provided in a lamination direction of layers. Further, each of the first main line, the first sub-line, the second sub-line, and the second main line is divided into at least two divided coil conductors. Furthermore, at least two divided ground conductors are provided between the first sub-line and the second sub-line.

17 Claims, 5 Drawing Sheets

DIRECTIONAL COUPLER

BACKGROUND OF THE INVENTION

1. Field of the Invention

The present invention relates to a directional coupler, and more specifically, to a directional coupler which is capable of reducing the operating frequency thereof, improving the degree of electromagnetic coupling between a main line and a sub-line, and reducing the height thereof, and which facilitates impedance design of respective terminals.

2. Description of the Related Art

For example, a known directional coupler is disclosed in Japanese Unexamined Patent Application Publication No. 8-237012 as including a laminate block in which a plurality of dielectric layers including coil conductors or ground conductors disposed thereon are laminated. Two coil conductors are provided inside the laminate block, with one of the coil conductors defining a main line and the other coil conductor defining a sub-line. Further, the main line and the sub-line are electromagnetically coupled to each other. Further, the ground conductors sandwich the coil conductors in a lamination direction.

In the directional coupler having the above-described configuration, upon input of a signal to one end of the main line, a signal having power proportional to the power of the input signal is output from one end of the sub-line.

There is a case in which it is desirable to reduce the operating frequency of such a directional coupler. In such a case, a method of increasing the line lengths of the main line and the sub-line is conceivable. However, according to the method, it is necessary to increase the area of the dielectric layers on which the main line and the sub-line are disposed. Thus, a problem arises in that the size of the directional coupler must be increased.

In view of the above, another known directional coupler disclosed in Japanese Unexamined Patent Application Publication No. 2003-69317 uses a method of dividing both of the main line and the sub-line in different layers inside the laminate block, to thereby increase the line lengths of the coil conductors.

FIG. 6 illustrates a directional coupler 400 disclosed in Japanese Unexamined Patent Application Publication No. 2003-69317. FIG. 6 is an exploded perspective view of the directional coupler 400.

The directional coupler 400 includes a laminate block 101 including a plurality of laminated dielectric layers 101*a* to 101*g*.

Further, a coil conductor 102*a* provided on a surface of the dielectric layer 101*c*, a via conductor 102*b* provided through the dielectric layer 101*d*, a via conductor 102*c* provided through the dielectric layer 101*e*, a via conductor 102*d* provided through the dielectric layer 101*f*, and a coil conductor 102*e* provided on a surface of the dielectric layer 101*f* are sequentially connected to define a main line. In the laminate block 101, the main line is divided into a first main line defined by the coil conductor 102*a* and a second main line defined by the coil conductor 102*e*.

Similarly, a coil conductor 103*a* provided on a surface of the dielectric layer 101*b*, a via conductor 103*b* provided through the dielectric layer 101*c*, a via conductor 103*c* provided through the dielectric layer 101*d*, a via conductor 103*d* provided through the dielectric layer 101*e*, and a coil conductor 103*e* provided on a surface of the dielectric layer 101*e* are sequentially connected to define a sub-line. In the laminate block 101, the sub-line is divided into a first sub-line defined by the coil conductor 103*a* and a second sub-line defined by the coil conductor 103*e*.

Further, the first main line (coil conductor) 102*a* and the first sub-line (coil conductor) 103*a* are electromagnetically coupled to define a first coupling portion 104, and the second main line (coil conductor) 102*e* and the second sub-line (coil conductor) 103*e* are electromagnetically coupled to define a second coupling portion 105.

Further, ground conductors 106*a*, 106*b*, and 106*c* are provided on a surface of the dielectric layer 101*a*, a surface of the dielectric layer 101*d*, and a surface of the dielectric layer 101*g*, respectively. Each of the ground conductors 106*a*, 106*b*, and 106*c* functions as a shield. Particularly, the ground conductor 106*b* is intended to prevent the occurrence of unnecessary signal leakage between the first coupling portion 104 and the second coupling portion 105. A central portion of the ground conductor 106*b* is provided with an opening to allow the via conductor 102*b* and the via conductor 103*c* to pass therethrough.

In the existing directional coupler 400 having the above-described structure, the main line and the sub-line are both divided in different layers inside the laminate block 100, to thereby allow an increase in line length of the coil conductors without a reduction in dimension of the elements in a planar direction.

However, in the above-described known directional coupler 400, the ground conductor 106*b* is provided on substantially the entire surface of the dielectric layer 101*d* to prevent coupling between the first coupling portion 104 and the second coupling portion 105. As a result, the following problem arises.

That is, the ground conductor 106*b* is provided on substantially the entire surface of the dielectric layer 101*d*, and the first main line 102*a* and the second sub-line 103*e* both face the ground conductor 106*b*. Therefore, there arises a problem in that it is difficult to optimize impedance characteristics of an output end derived from the first main line 102*a* and impedance characteristics of a coupling end derived from the second sub-line 103*e*.

For example, to reduce the impedance value of the output end derived from the first main line 102*a* and the impedance value of the coupling end derived from the second sub-line 103*e*, it is necessary to increase the thickness of the dielectric layer 101*d* and thereby increase the distance between the ground conductor 106*b* and the first main line 102*a*, and to increase the thickness of the dielectric layer 101*e* and thereby increase the distance between the ground conductor 106*b* and the second sub-line 103*e*. In this case, there arises a problem in that the height dimension of the laminate block 101 is increased.

SUMMARY OF THE INVENTION

Preferred embodiments of the present invention provide a direction coupler that overcomes the problems described above.

A directional coupler according to a preferred embodiment of the present invention includes a laminate block including a plurality of laminated dielectric layers, a first terminal, a second terminal, a third terminal, and a fourth terminal provided on surfaces of the laminate block, a main line provided in the laminate block, and including coil conductors connected between the first terminal and the second terminal; and a sub-line provided in the laminate block, and including coil conductors connected between the third terminal and the fourth terminal and coupled to the main line. The main line is divided into two coil conductors including a first main line and a second main line disposed on different layers in the laminate block. The sub-line is divided into two coil conductors including a first sub-line and a second sub-line disposed on different layers in the laminate block. The first main line, the second main line, the first sub-line, and the second sub-line are arranged in order of the first main line, the first sub-line, the second sub-line, and the second main line or in order of the first sub-line, the first main line, the second main line, and the second sub-line in a lamination direction of the dielectric layers in the laminate block. The first main line and the first sub-line are coupled to define a first coupling portion. The second main line and the second sub-line are coupled to define a second coupling portion. A ground conductor is provided on a layer between the first coupling portion and the second coupling portion. Each of the first main line, the second main line, the first sub-line, and the second sub-line is further divided into at least two divided coil conductors on a layer including the corresponding one of the first main line, the second main line, the first sub-line, and the second sub-line disposed thereon. The ground conductor is divided into at least two divided ground conductors.

The directional coupler including the above-described structure facilitates impedance design of terminals and enables the height of the directional coupler to be reduced.

Each of the first main line, the second main line, the first sub-line, and the second sub-line may preferably be divided into two spiral divided coil conductors on the layer including the corresponding one of the first main line, the second main line, the first sub-line, and the second sub-line disposed thereon, and the two divided coil conductors may preferably be arranged to be point-symmetrical or substantially point-symmetrical. In this case, the divided coil conductors preferably are spirally shaped, for example. Therefore, it is possible to increase the respective line lengths of the coil conductors of the main line and the sub-line in the same unit area. Further, the two divided coil conductors are arranged to be point-symmetrical or substantially point-symmetrical and similar in shape. Therefore, designing the impedance of each of the main line and the sub-line is facilitated.

Further, the at least two divided ground conductors may preferably be provided on different layers. In this case, it is possible to freely design the distance between each of the divided ground conductors and the divided coil conductor adjacent thereto in the lamination direction. Therefore, it is possible to more easily design the impedance of each of terminals derived from the divided coil conductors.

Further, the two or more divided ground conductors may preferably be provided on the same layer. In this case, it is possible to reduce the number of dielectric layers provided in the laminate block, and thus, to reduce the height of the directional coupler.

Further, the at least two divided ground conductors may preferably be connected to each other. In this case, it is possible to more effectively stabilize the potential of the divided ground conductors.

Further, as viewed in the lamination direction of the dielectric layers of the laminate block, the at least two divided ground conductors may preferably be arranged to at least partially overlap the two or more divided coil conductors. In this case, the influence of the divided ground conductors on the divided coil conductors is increased. Therefore, designing the impedance of each of the terminals derived from the divided coil conductors is further facilitated.

The directional coupler according to various preferred embodiments of the present invention is capable of reducing the center frequency thereof and improving the degree of electromagnetic coupling between the main line and the sub-line by increasing the line lengths of the main line and the sub-line.

Further, each of the first main line, the second main line, the first sub-line, and the second sub-line is divided into at least two divided coil conductors on a layer including the corresponding one of the first main line, the second main line, the first sub-line, and the second sub-line disposed thereon. Furthermore, the ground conductor provided on a layer between the first coupling portion and the second coupling portion is not provided on substantially an entire surface of the layer, and is divided into at least two divided ground conductors. Therefore, designing the impedance of each of the terminals derived from the divided coil conductors is further facilitated by adjusting the size of each of the divided ground conductors, or by adjusting the distance between the divided ground conductor and the divided coil conductor adjacent thereto in the lamination direction.

Further, it is possible to reduce the influence of the divided ground conductor on characteristics of the divided coil conductor adjacent thereto in the lamination direction by adjusting the shape or size of the divided ground conductor. Accordingly, it is possible to reduce the distance between the divided ground conductor and the divided coil conductor, and thus, to reduce the height of the laminate block and the height of the directional coupler.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

With reference to the drawings, preferred embodiments of the present invention will be described below.

First Preferred Embodiment

Figure 1:
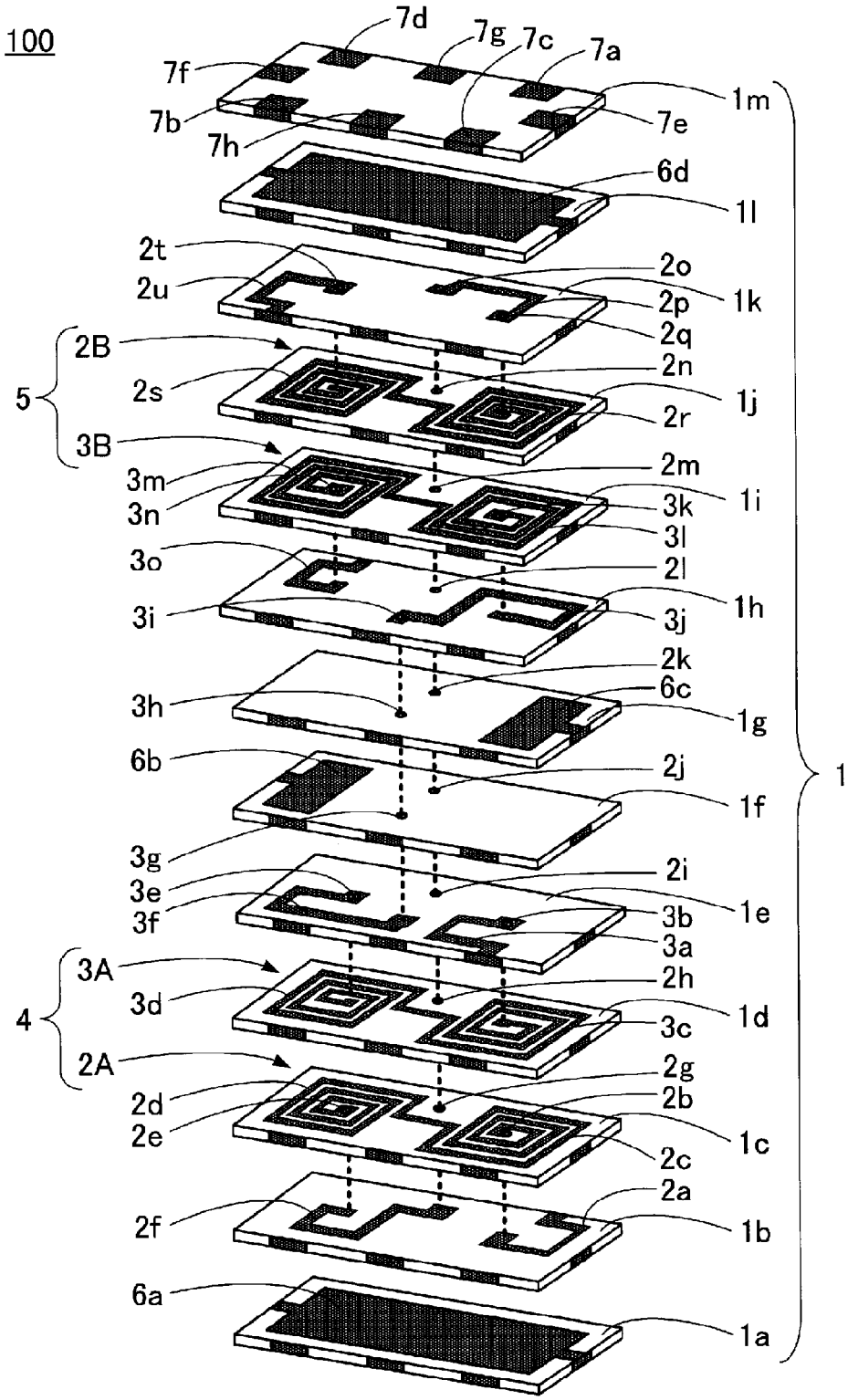
FIG. 1 is an exploded perspective view illustrating a directional coupler according to a first preferred embodiment of the present invention.
Figure 2:
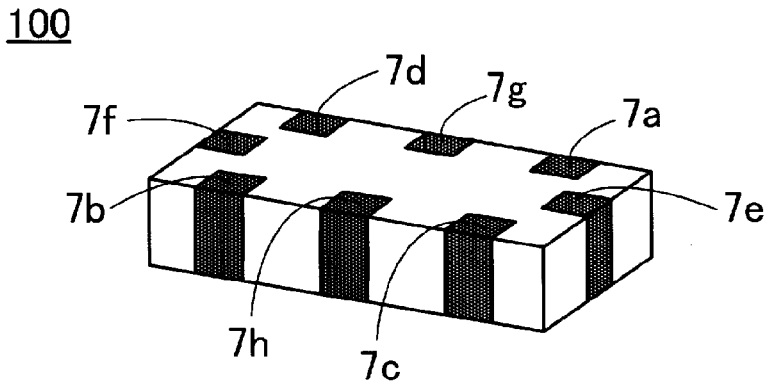
FIG. 2 is a perspective view illustrating the directional coupler according to the first preferred embodiment of the present invention.
Figure 3:
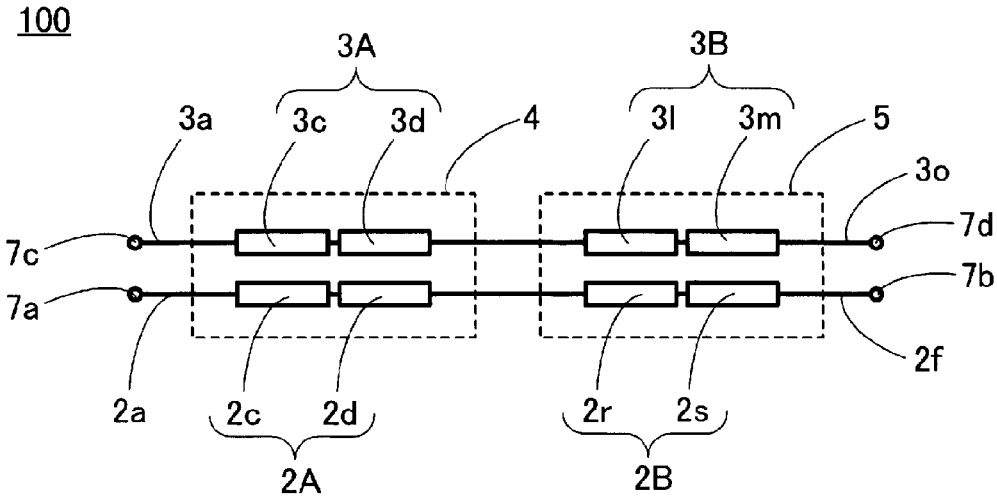
FIG. 3 is an equivalent circuit diagram of the directional coupler according to the first preferred embodiment of the present invention.

FIGS. 1 to 3 illustrate a directional coupler 100 according to a first preferred embodiment of the present invention. FIG. 1 is an exploded perspective view. FIG. 2 is a perspective view. FIG. 3 is an equivalent circuit diagram.

Firstly, as illustrated in FIG. 1, the directional coupler 100 according to the first preferred embodiment of the present invention includes a laminate block 1 including a plurality of laminated dielectric layers 1*a* to 1*m*.

Further, a connecting coil conductor 2*a* provided on a surface of the dielectric layer 1*b*, a via conductor 2*b* provided through the dielectric layer 1*c*, a divided coil conductor 2*c* provided on a surface of the dielectric layer 1*c*, a divided coil conductor 2*d* provided on the surface of the dielectric layer 1*c*, a via conductor 2*e* provided through the dielectric layer 1*c*, a connecting coil conductor 2*f* provided on the surface of the dielectric layer 1*b*, a via conductor 2*g* provided through the dielectric layer 1*c*, a via conductor 2*h* provided through the dielectric layer 1*d*, a via conductor 2*i* provided through the dielectric layer 1*e*, a via conductor 2*j* provided through the dielectric layer 1*f*, a via conductor 2*k* provided through the dielectric layer 1*g*, a via conductor 2*l* provided through the dielectric layer 1*h*, a via conductor 2*m* provided through the dielectric layer 1*i*, a via conductor 2*n* provided through the dielectric layer 1*j*, a via conductor 2*o* provided through the dielectric layer 1*k*, a connecting coil conductor 2*p* provided on a surface of the dielectric layer 1*k*, a via conductor 2*q* provided through the dielectric layer 1*k*, a divided coil conductor 2*r* provided on a surface of the dielectric layer 1*j*, a divided coil conductor 2*s* provided on the surface of the dielectric layer 1*j*, a via conductor 2*t* provided through the dielectric layer 1*k*, and a connecting coil conductor 2*u* provided on the surface of the dielectric layer 1*k* are sequentially connected to define a main line.

In the laminate block 1, the main line is divided into a first main line 2A including the divided coil conductor 2*c* and the divided coil conductor 2*d* provided on a surface of the dielectric layer 1*c*, and a second main line 2B including the divided coil conductor 2*r* and the divided coil conductor 2*s* provided on a surface of the dielectric layer 1*j*.

The divided coil conductor 2*c* and the divided coil conductor 2*d* defining the first main line 2A are preferably arranged to be the same shape and point-symmetrical or substantially the same shape and substantially point-symmetrical. Further, the divided coil conductor 2*r* and the divided coil conductor 2*s* defining the second main line 2B are preferably arranged to be the same shape and point-symmetrical or substantially the same shape and substantially point-symmetrical.

Similarly, a connecting coil conductor 3*a* provided on a surface of the dielectric layer 1*e*, a via conductor 3*b* provided through the dielectric layer 1*e*, a divided coil conductor 3*c* provided on a surface of the dielectric layer 1*d*, a divided coil conductor 3*d* provided on the surface of the dielectric layer 1*d*, a via conductor 3*e* provided through the dielectric layer 1*e*, a connecting coil conductor 3*f* provided on the surface of the dielectric layer 1*e*, a via conductor 3*g* provided through the dielectric layer 1*f*, a via conductor 3*h* provided through the dielectric layer 1*g*, a via conductor 3*i* provided through the dielectric layer 1*h*, a connecting coil conductor 3*j* provided on a surface of the dielectric layer 1*h*, a via conductor 3*k* provided through the dielectric layer 1*i*, a divided coil conductor 3*l* provided on a surface of the dielectric layer 1*i*, a divided coil conductor 3*m* provided on the surface of the dielectric layer 1*i*, a via conductor 3*n* provided through the dielectric layer 1*i*, and a connecting coil conductor 3*o* provided on the surface of the dielectric layer 1*h* are sequentially connected to define a sub-line.

In the laminate block 1, the sub-line is divided into a first sub-line 3A including the divided coil conductor 3*c* and the divided coil conductor 3*d* provided on a surface of the dielectric layer 1*d*, and a second sub-line 3B including the divided coil conductor 3*l* and the divided coil conductor 3*m* provided on a surface of the dielectric layer 1*i*.

The divided coil conductor 3*c* and the divided coil conductor 3*d* defining the first sub-line 3A are preferably arranged to be the same shape and point-symmetrical or substantially the same shape and substantially point-symmetrical. Further, the divided coil conductor 3*l* and the divided coil conductor 3*m* defining the second sub-line 3B are preferably arranged to be the same shape and point-symmetrical or substantially the same shape and substantially point-symmetrical.

Further, the first main line 2A and the first sub-line 3A are electromagnetically coupled to define a first coupling portion 4, and the second main line 2B and the second sub-line 3B are electromagnetically coupled to define a second coupling portion 5.

Further, a ground conductor 6*a* is provided on substantially the entire surface of the dielectric layer 1*a*, and a divided ground conductor 6*b* is provided on a surface of the dielectric layer 1*f* at one side thereof (the left side in FIG. 1). A divided ground conductor 6*c* is provided on a surface of the dielectric layer 1*g* at one side thereof (the right side in FIG. 1), and a ground conductor 6*d* is provided on substantially the entire surface of the dielectric layer 1*l*.

Each of the ground conductor 6*a*, the divided ground conductor 6*b*, the divided ground conductor 6*c*, and the ground conductor 6*d* functions as a shield.

Particularly, the divided ground conductor 6*b* and the divided ground conductor 6*c* prevent coupling between the first coupling portion 4 and the second coupling portion 5.

Further, the divided ground conductor 6*b* primarily affects impedance characteristics of the connecting coil conductor 3*f* and the divided coil conductor 3*d*. Therefore, the shape and/or size of the divided ground conductor 6*b* or the distance from the divided ground conductor 6*b* to the connecting coil conductor 3*f* and the divided coil conductor 3*d* may be changed to facilitate the design of impedance characteristics of a coupling end derived from the first sub-line 3A. Similarly, the divided ground conductor 6*c* primarily affects impedance characteristics of the connecting coil conductor 3*j* and the divided coil conductor 3*l*. Therefore, the shape and/or size of the divided ground conductor 6*c* or the distance from the divided ground conductor 6*c* to the connecting coil conductor 3*j* and the divided coil conductor 3*l* may be changed to facilitate the design of impedance characteristics of a terminating end derived from the second sub-line 3B.

In preferred embodiments of the present invention, a ground conductor between the first coupling portion 4 and the second coupling portion 5 may be divided into two or more portions, such as the divided ground conductor 6*b* and the divided ground conductor 6*c*, because of the division of the respective lines. That is, in the present preferred embodiment, such an arrangement is provided because of the division of the first main line 2A into the divided coil conductor 2*c* and the divided coil conductor 2*d*, the division of the first sub-line 3A into the divided coil conductor 3*c* and the divided coil conductor 3*d*, the division of the second sub-line 3B into the divided coil conductor 3*l* and the divided coil conductor 3*m*, and the division of the second main line 2B into the divided coil conductor 2*r* and the divided coil conductor 2*s*.

As illustrated in FIG. 2, necessary terminals 7*a* to 7*h* are provided on surfaces of the laminate block 1, and are connected to selected wiring lines inside the laminate block 1. An input terminal 7*a* is connected to the connecting coil conductor 2*a* provided on a surface of the dielectric layer 1*b*. An output terminal 7*b* is connected to the connecting coil conductor 2*u* provided on a surface of the dielectric layer 1*k*. A coupling terminal 7*c* is connected to the connecting coil conductor 3*a* provided on a surface of the dielectric layer 1*e*. A terminating terminal 7*d* is connected to the connecting coil conductor 3*o* provided on a surface of the dielectric layer 1*h*. A ground terminal 7*e* is connected to the ground conductor 6*a*, the divided ground conductor 6*c*, and the ground conductor 6*d*. A ground terminal 7*f* is connected to the ground conductor 6*a*, the divided ground conductor 6*b*, and the ground conductor 6*d*. Dummy terminals 7*g* and 7*h* are not connected to any of the conductors.

FIG. 3 illustrates an equivalent circuit diagram of the directional coupler 100 according to the present preferred embodiment. In the directional coupler 100, the main line is provided between the input terminal 7*a* and the output terminal 7*b*, and is divided into the first main line 2A and the second main line 2B. The first main line 2A is further divided into the divided coil conductor 2*c* and the divided coil conductor 2*d*, and the second main line 2B is further divided into the divided coil conductor 2*r* and the divided coil conductor 2*s*. Similarly, the sub-line is provided between the coupling terminal 7*c* and the terminating terminal 7*d*, and is divided into the first sub-line 3A and the second sub-line 3B. The first sub-line 3A is further divided into the divided coil conductor 3*c* and the divided coil conductor 3*d*, and the second sub-line 3B is further divided into the divided coil conductor 3*l* and the divided coil conductor 3*m*. Further, the first main line 2A and the first sub-line 3A are coupled to define the first coupling portion 4, and the second main line 2B and the second sub-line 3B are coupled to define the second coupling portion 5.

Upon input of a signal to the input terminal 7*a* of the directional coupler 100 according to the present preferred embodiment, a signal having power proportional to the power of the input signal is output from the coupling terminal 7*c*.

The directional coupler 100 according to the first preferred embodiment of the present invention having the above-described structure is preferably manufactured by, for example, the following non-limiting example of a method of manufacturing.

To form the dielectric layers 1*a* to 1*m*, ceramic green sheets primarily made of $BaO—Al_2O_3$, for example, are first prepared.

Then, predetermined ceramic green sheets are provided with holes for forming the via conductors 2*b*, 2*e*, 2*g*, 2*h*, 2*i*, 2*j*, 2*k*, 2*l*, 2*m*, 2*n*, 2*o*, 2*q*, 2*t*, 3*b*, 3*e*, 3*g*, 3*h*, 3*i*, 3*k*, and 3*n*, and the holes are filled with a conductive paste.

Further, a conductive paste is applied to surfaces of selected ceramic green sheets in desired pattern shapes to form the connecting coil conductors 2*a*, 2*f*, 2*p*, 2*u*, 3*a*, 3*f*, 3*j*, and 3*o*, the divided coil conductors 2*c*, 2*d*, 2*r*, 2*s*, 3*c*, 3*d*, 31, and 3*m*, the ground conductors 6*a* and 6*d*, and the divided ground conductors 6*b* and 6*c*.

The conductive paste for filling the holes for the via conductors and the conductive paste applied to the surfaces of the ceramic green sheets may preferably be, for example, a conductive paste primarily made of copper. The filling of the holes for the via conductors with the conductive paste may be performed simultaneously with the application of the conductive paste to the surfaces of the ceramic green sheets, for example.

Then, the ceramic green sheets are laminated in a predetermined order, applied with pressure, and fired with a predetermined profile so as to form the laminate block 1.

Finally, a conductive paste preferably primarily made of copper, for example, is applied to surfaces of the laminate block 1 in desired pattern shapes, and is fired at a predetermined temperature, to thereby form the input terminal 7*a*, the output terminal 7*b*, the coupling terminal 7*c*, the terminating terminal 7*d*, the ground terminals 7*e* and 7*f*, and the dummy terminals 7*g* and 7*h*. As a result, the directional coupler 100 according to the first preferred embodiment of the present invention is produced.

A description has been provided of the structure of the directional coupler 100 according to the first preferred embodiment of the present invention and a non-limiting example of the manufacturing method therefor. However, the present invention, is not limited to the description, and may be modified in various ways without departing from the scope and spirit of the present invention.

For example, in the present preferred embodiment, the first main line 2A, the second main line 2B, the first sub-line 3A, and the second sub-line 3B are preferably laminated in order of the first main line 2A, the first sub-line 3A, the second sub-line 3B, and the second main line 2B in a lamination direction of layers in the laminate block 1. Alternatively, the lines may be laminated in order of the first sub-line 3A, the first main line 2A, the second main line 2B, and the second sub-line 3B, for example.

Further, the shape and size of the divided ground conductors 6*b* and 6*c* are arbitrary, and may be changed as appropriate. Further, the respective thicknesses of the dielectric layers, such as the dielectric layers 1*f*, 1*g*, and 1*h*, are arbitrary, and may be changed as appropriate.

In the present preferred embodiment, the divided ground conductors 6*b* and 6*c* are preferably provided on surfaces of different dielectric layers. That is, preferably, the divided ground conductor 6*b* is provided on a surface of the dielectric layer 1*f*, and the divided ground conductor 6*c* is provided on a surface of the dielectric layer 1*g*. However, the divided ground conductors 6*b* and 6*c* may be provided on a surface of the same dielectric layer. In this case, the distance from the divided ground conductor 6*b* to the connecting coil conductor 3*f* and the divided coil conductor 3*d* is equal to or substantially equal to the distance from the divided ground conductor 6*c* to the connecting coil conductor 3*a* and the divided coil conductor 3*c*. Similarly, the distance from the divided ground conductor 6*b* to the connecting coil conductor 3*o* and the divided coil conductor 3*m* is equal to or substantially equal to the distance from the divided ground conductor 6*c* to the connecting coil conductor 3*j* and the divided coil conductor 3*l*.

In this case, the shape and/or size of the divided ground conductor 6*b* may be different from the shape and/or size the divided ground conductor 6*c* to differentiate the degree of influence of the divided ground conductor 6*b* on the connecting coil conductor 3*f* and the divided coil conductor 3*d* from the degree of influence of the divided ground conductor 6*c* on the connecting coil conductor 3*a* and the divided coil conductor 3*c*, and similarly differentiate the degree of influence of the divided ground conductor 6*b* on the connecting coil conductor 3*o* and the divided coil conductor 3*m* from the degree of influence of the divided ground conductor 6*c* on the connecting coil conductor 3*j* and the divided coil conductor 3*l*, so as to enable the design of respective impedance characteristics of the coupling end and the terminating end derived from the sub-line. The distance from the divided ground conductor 6*b* and the divided ground conductor 6*c* to the connecting coil conductor 3*f*, the divided coil conductor 3*d*, the divided coil conductor 3*c*, and the connecting coil conductor 3*a* defining the first sub-line 3A and the distance from the divided ground conductor 6*b* and the divided ground conductor 6*c* to the connecting coil conductor 3*j*, the divided coil conductor 3*l*, the divided coil conductor 3*m*, and the connecting coil conductor defining the second sub-line 3B may be different from each other by setting different thicknesses for the interposed dielectric layers. Making these distances different from each other may also be used as a factor in designing the impedance characteristics.

Second Preferred Embodiment

Figure 4:
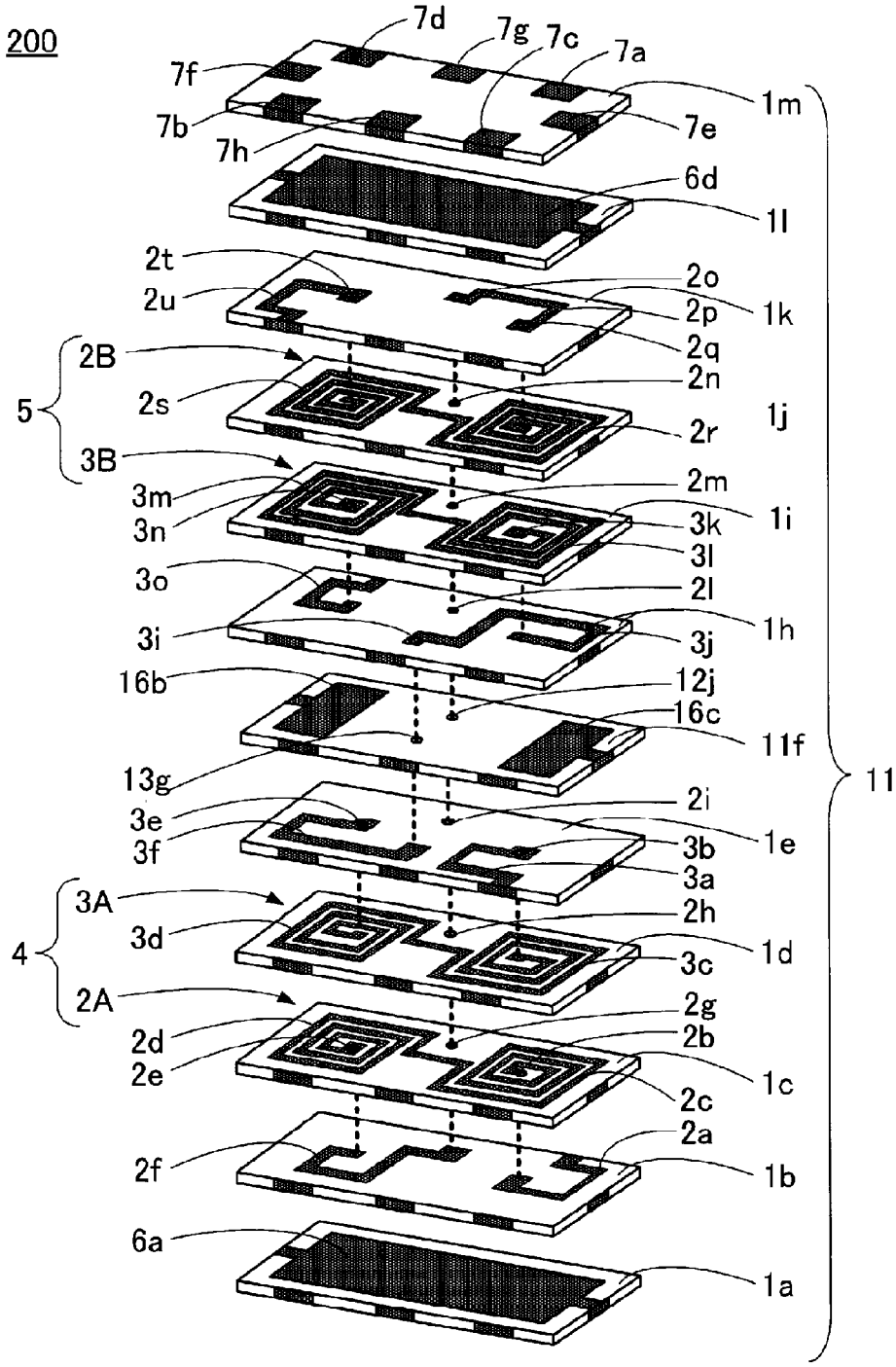
FIG. 4 is an exploded perspective view illustrating a directional coupler according to a second preferred embodiment of the present invention.

FIG. 4 illustrates a directional coupler 200 according to a second preferred embodiment of the present invention.

In the directional coupler 200, two divided ground conductors are provided on one dielectric layer, in place of the configuration of the directional coupler 100 according to the first preferred embodiment illustrated in FIG. 1, in which the divided ground conductor 6*b* and the divided ground conductor 6*c* are separately provided on two dielectric layers of the dielectric layer 1*f* and the dielectric layer 1*g*, respectively. That is, in the directional coupler 200, two divided ground conductors 16*b* and 16*c* are provided on a dielectric layer 11*f* in place of the dielectric layer 1*f* and the dielectric layer 1*g*. The dielectric layer 11*f* is also provided with a via conductor 12*j* and a via conductor 13*g*.

In the directional coupler 200, the dielectric layers 1*a* to 1*e*, the dielectric layer 11*f*, and the dielectric layers 1*h* to 1*m* are sequentially laminated to define a laminate block 11. In the remaining configuration, the directional coupler 200 is preferably the same or substantially the same as the directional coupler 100 of the first preferred embodiment illustrated in FIG. 1.

In the directional coupler 200, the divided ground conductor 16*b* and the divided ground conductor 16*c* are both provided on the single dielectric layer 11*f*, thus enabling the omission of one dielectric layer. Accordingly, the height of the directional coupler is further reduced.

Third Preferred Embodiment

Figure 5:
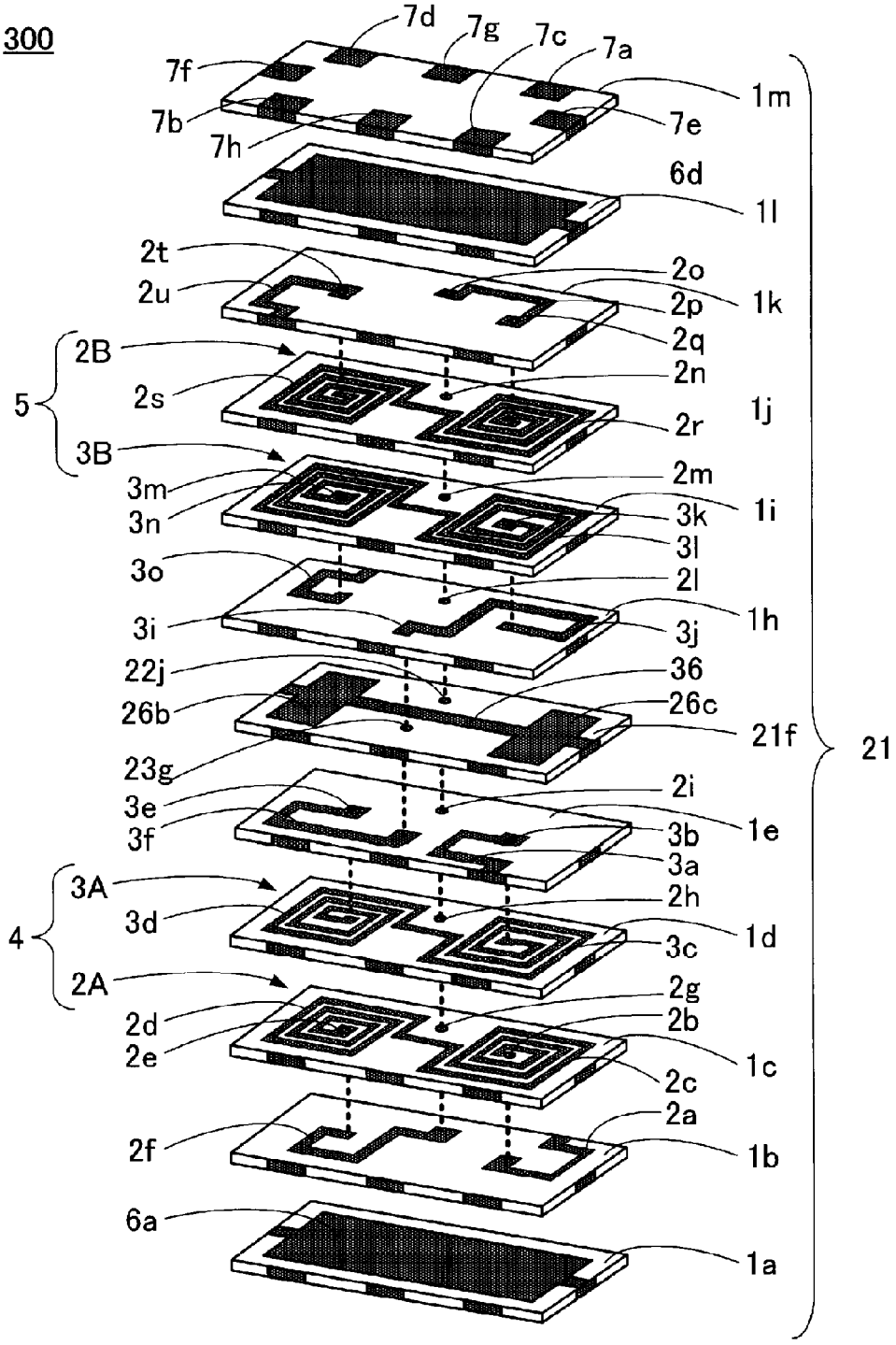
FIG. 5 is an exploded perspective view illustrating a directional coupler according to a third preferred embodiment of the present invention.
Figure 6:
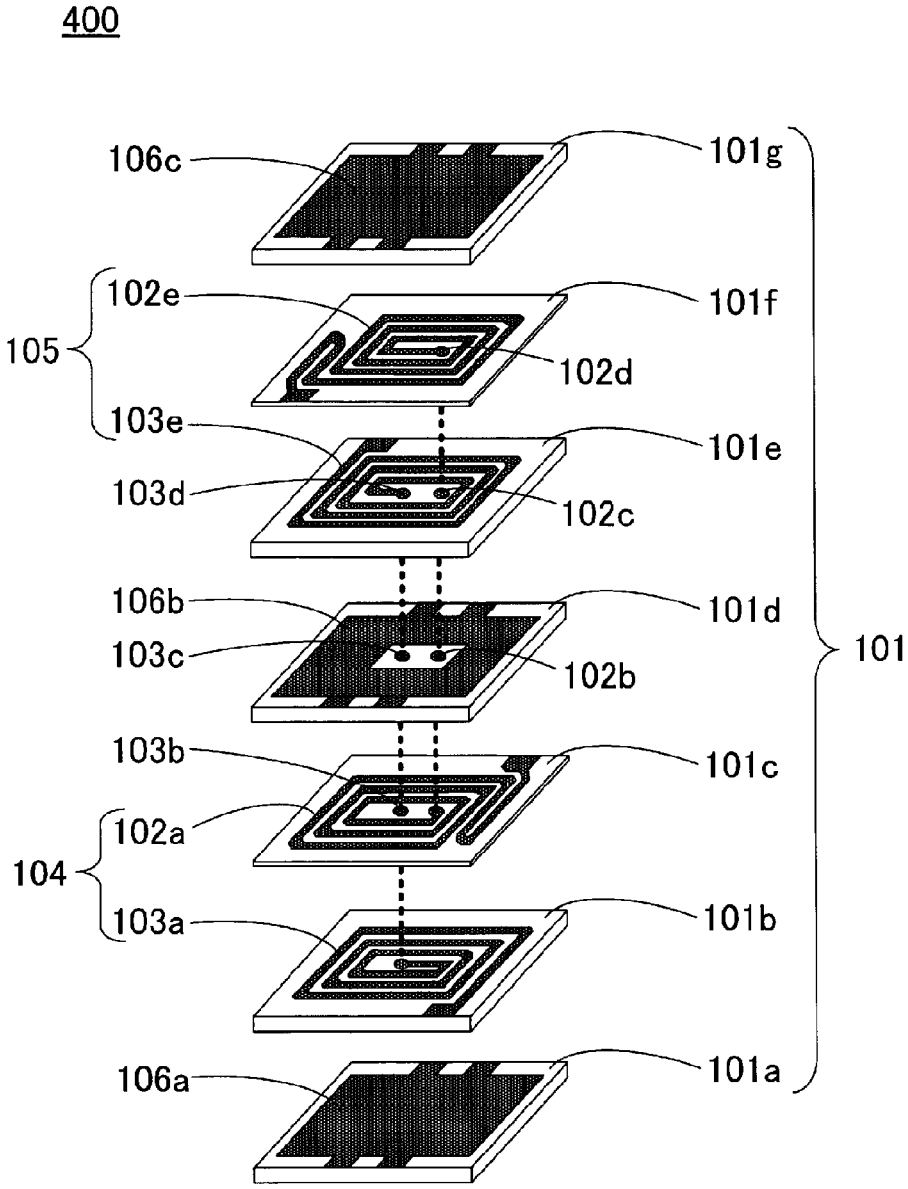
FIG. 6 Prior Art
FIG. 6 is an exploded perspective view illustrating a known directional coupler.

FIG. 5 illustrates a directional coupler 300 according to a third preferred embodiment of the present invention.

In the directional coupler 300, two divided ground conductors are connected to each other by a connecting ground conductor, in place of the configuration of the directional coupler 200 according to the second preferred embodiment illustrated in FIG. 4, in which the two divided ground conductors 16*b* and 16*c* are arranged to be isolated from each other on the dielectric layer 11*f*. That is, in the directional coupler 300, two divided ground conductors 26*b* and 26*c* are provided on a dielectric layer 21*f* in place of the dielectric layer 11*f*, and are connected to each other by a connecting ground conductor 36. The dielectric layer 21*f* also includes a via conductor 22*j* and a via conductor 23*g*.

In the directional coupler 300, the dielectric layers 1*a* to 1*e*, the dielectric layer 21*f*, and the dielectric layers 1*h* to 1*m* are sequentially laminated to form a laminate block 21. In the remaining configurations, the directional coupler 300 is preferably the same or substantially the same as the directional coupler 200 of the second preferred embodiment illustrated in FIG. 4.

In the directional coupler 300, the divided ground conductor 26*b* and the divided ground conductor 26*c* are connected by the connecting ground conductor 36. Therefore, the ground potential is more stable, and it is possible to more effectively stabilize the impedance characteristics of the coupling terminal 7*c* derived from the first sub-line 3A and the impedance characteristics of the terminating terminal 7*d* derived from the second sub-line 3Bd.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler comprising:

a laminate block including a plurality of laminated dielectric layers stacked in a stacking direction;

a first terminal, a second terminal, a third terminal, and a fourth terminal provided on surfaces of the laminate block;

a main line provided in the laminate block, and including coil conductors connected between the first terminal and the second terminal; and a sub-line provided in the laminate block, and including coil conductors connected between the third terminal and the fourth terminal and coupled to the main line; wherein the coil conductors of the main line are divided into a first main line and a second main line disposed on different dielectric layers in the laminate block;

the coil conductors of the sub-line are divided into a first sub-line and a second sub-line on different dielectric layers in the laminate block;

the first main line, the second main line, the first sub-line, and the second sub-line are arranged in order of the first main line, the first sub-line, the second sub-line, and the second main line or in order of the first sub-line, the first main line, the second main line, and the second sub-line in a lamination direction of the dielectric layers in the laminate block;

the first main line and the first sub-line are coupled to define a first coupling portion;

the second main line and the second sub-line are coupled to define a second coupling portion;

a ground conductor is provided on a dielectric layer of the laminate block between the first coupling portion and the second coupling portion;

each of the first main line, the second main line, the first sub-line, and the second sub-line is further divided into at least two divided coil conductors on a dielectric layer including a corresponding one of the first main line, the second main line, the first sub-line, and the second sub-line;

the ground conductor is divided into at least two divided ground conductors that are located at opposite ends of the laminate block and do not overlap each other in a planar view along the stacking direction.

2. The directional coupler according to claim 1, wherein each of the first main line, the second main line, the first sub-line, and the second sub-line is divided into two spiral divided coil conductors on the dielectric layer including the corresponding one of the first main line, the second main line, the first sub-line, and the second sub-line.

3. The directional coupler according to claim 1, wherein the at least two divided ground conductors are provided on different dielectric layers of the laminate block.

4. The directional coupler according to claim 1, wherein the at least two divided ground conductors are provided on the same dielectric layer of the laminate block.

5. The directional coupler according to claim 4, wherein the at least two divided ground conductors are connected to each other.

6. The directional coupler according to claim 1, wherein, as viewed in the lamination direction of the dielectric layers of the laminate block, the at least two divided ground conductors are arranged to at least partially overlap the at least two divided coil conductors.

7. The directional coupler according to claim 2, wherein the two spiral divided coil conductors are point-symmetrical or substantially point-symmetrical.

8. The directional coupler according to claim 2, wherein the two spiral divided coil conductors have the same shape or substantially the same shape.

9. A directional coupler comprising:

a laminate block including a plurality of laminated dielectric layers stacked in a stacking direction;

a main line provided in the laminate block; and a sub-line provided in the laminate block and coupled to the main line; wherein the main line is divided into a first main line and a second main line disposed on different dielectric layers in the laminate block;

the sub-line is divided into a first sub-line and a second sub-line on different dielectric layers in the laminate block;

the first main line, the second main line, the first sub-line, and the second sub-line are arranged in order of the first main line, the first sub-line, the second sub-line, and the second main line or in order of the first sub-line, the first main line, the second main line, and the second sub-line in a lamination direction of the dielectric layers in the laminate block;

the first main line and the first sub-line are coupled to define a first coupling portion;

the second main line and the second sub-line are coupled to define a second coupling portion;

a ground conductor is provided on a dielectric layer of the laminate block between the first coupling portion and the second coupling portion;

each of the first main line, the second main line, the first sub-line, and the second sub-line is further divided into at least two divided coil conductors on a dielectric layer including a corresponding one of the first main line, the second main line, the first sub-line, and the second sub-line;

the ground conductor is divided into at least two divided ground conductors that are located at opposite ends of the laminate block and do not overlap each other in a planar view along the stacking direction.

10. The directional coupler according to claim 9, further comprising:

a first terminal, a second terminal, a third terminal, and a fourth terminal provided on surfaces of the laminate block; wherein the main line is connected between the first terminal and the second terminal; and the sub-line is connected between the third terminal and the fourth terminal.

11. The directional coupler described in claim 9, wherein each of the first main line, the second main line, the first sub-line, and the second sub-line is divided into two spiral divided coil conductors on the dielectric layer including the corresponding one of the first main line, the second main line, the first sub-line, and the second sub-line.

12. The directional coupler described in claim 9, wherein the at least two divided ground conductors are provided on different layers of the laminate block.

13. The directional coupler described in claim 9, wherein the at least two divided ground conductors are provided on the same layer of the laminate block.

14. The directional coupler described in claim 13, wherein the at least two divided ground conductors are connected to each other.

15. The directional coupler described in claim 9, wherein, as viewed in the lamination direction of the dielectric layers of the laminate block, the at least two divided ground conductors are arranged to at least partially overlap the at least two divided coil conductors.

16. The directional coupler described in claim 11, wherein the two spiral divided coil conductors are point-symmetrical or substantially point-symmetrical.

17. The directional coupler described in claim 11, wherein the two spiral divided coil conductors have the same shape or substantially the same shape.

* * * * *